US010718125B2

(12) United States Patent
Lopez

(10) Patent No.: US 10,718,125 B2
(45) Date of Patent: Jul. 21, 2020

(54) MONOLITHIC ROOF ANCHOR

(71) Applicant: WERNER CO., Greenville, PA (US)

(72) Inventor: Ivan D. Lopez, Hermitage, PA (US)

(73) Assignee: WERNER CO., Greenville, PA (US)

( * ) Notice: Subject to any disclaimer, the term of this patent is extended or adjusted under 35 U.S.C. 154(b) by 90 days.

(21) Appl. No.: 15/071,316

(22) Filed: Mar. 16, 2016

(65) Prior Publication Data

US 2017/0268243 A1 Sep. 21, 2017

(51) Int. Cl.
*E04G 21/32* (2006.01)
*A62B 35/00* (2006.01)

(52) U.S. Cl.
CPC ..... *E04G 21/3276* (2013.01); *A62B 35/0068* (2013.01); *E04G 21/3214* (2013.01); *E04G 21/3223* (2013.01)

(58) Field of Classification Search
CPC ..... E04G 21/3214; E04G 21/3223; E04G 21/3276; E04G 21/328; E04G 21/3285; A62B 35/0068
USPC .... 248/237, 300, 231.9, 231.91, 925; 182/3, 182/45; 52/698, 712, 715
See application file for complete search history.

(56) References Cited

U.S. PATENT DOCUMENTS 4,249,713 A 2/1981 Glynn et al.
D260,758 S * 9/1981 Borugian ..... D12/180
4,665,672 A 5/1987 Commins et al.
4,685,265 A 8/1987 Cooper
4,696,611 A 9/1987 Guay
4,723,128 A 2/1988 Gasque, Jr.
4,942,943 A 7/1990 Flaherty
5,011,106 A 4/1991 Cody
5,036,949 A 8/1991 Crocker et al.
5,054,576 A 10/1991 Glynn
(Continued)

FOREIGN PATENT DOCUMENTS

AU 2009 100 646 A4 8/2009
WO 2006/123979 A1 11/2006
(Continued)

OTHER PUBLICATIONS

Collins English Dictionary, Definition of Trapezoid, https://www.collinsdictionary.com/us/dictionary/english/trapezoid. (Year: 2018).*
(Continued)

*Primary Examiner* — Jonathan Liu
*Assistant Examiner* — Guang H Guan
(74) *Attorney, Agent, or Firm* — Eckert Seamans Cherin & Mellott, LLC

(57) ABSTRACT

A roof anchor including a mounting portion including a plurality of holes formed therein and an anchor portion having an opening formed therein. The mounting portion and the anchor portion are planar members arranged substantially perpendicular with each other. The anchor portion is disposed along one side of the mounting portion with a bend portion formed at an intersection of the mounting portion and the anchor portion. The mounting portion and the anchor portion form a monolithic piece. The opening includes a lower edge and an upper edge, wherein the lower edge is closer to the mounting portion than the upper edge, and wherein a length of the lower edge is greater than a length of the upper edge.

10 Claims, 13 Drawing Sheets

(56) References Cited

U.S. PATENT DOCUMENTS 5,137,112 A 8/1992 Nichols
5,287,944 A 2/1994 Woodyard
5,361,558 A 11/1994 Thornton et al.
5,553,685 A 9/1996 Cook
5,598,680 A * 2/1997 Wilhelmi ..... E04B 1/2608 52/715
5,636,704 A 6/1997 Castaneda
5,678,379 A * 10/1997 Quattrociocchi ..... E04B 1/2608 403/231
5,687,535 A 11/1997 Rohlf
5,730,407 A 3/1998 Ostrobrod
5,829,203 A 11/1998 Ealer, Sr.
5,845,452 A 12/1998 Pantano
5,878,534 A 3/1999 Gleave
5,896,719 A 4/1999 Thornton
5,964,438 A * 10/1999 Camilleri ..... A47B 95/008 248/225.21
5,975,239 A 11/1999 Castaneda
6,098,746 A 8/2000 Castaneda
6,227,329 B1 * 5/2001 Ador ..... A62B 35/0056 182/3
6,668,509 B1 12/2003 Krebs
6,669,156 B2 * 12/2003 East ..... E05D 15/24 16/94 R
6,729,079 B2 * 5/2004 Francies, III ..... E04G 21/142 52/125.2
7,175,140 B2 * 2/2007 Johnson ..... E04D 13/12 248/124.2
7,380,373 B2 6/2008 Crookston
7,665,248 B2 2/2010 Blackford
D622,642 S * 8/2010 Noble ..... D12/160
7,854,421 B2 12/2010 Florent
8,292,245 B2 10/2012 Schindler et al.
8,453,407 B2 * 6/2013 Tedesco ..... E04B 9/127 52/167.1
D700,500 S * 3/2014 Cochrane ..... D8/343
8,870,135 B2 * 10/2014 Grubbs ..... F16L 3/14 248/200
8,894,329 B1 * 11/2014 Kekahuna ..... F16B 13/066 405/259.3
9,003,715 B2 4/2015 Nurdogan
D730,545 S * 5/2015 Stauffer ..... D25/133
9,091,056 B2 * 7/2015 Stauffer ..... E04B 1/40
9,510,880 B2 * 12/2016 Terrill ..... A61B 17/8052
D788,950 S * 6/2017 Lopez ..... D25/199
D788,951 S * 6/2017 Lopez ..... E04B 1/2608 D25/199
D789,563 S * 6/2017 Lopez ..... A61B 17/8052 D25/199
D789,564 S * 6/2017 Lopez ..... D25/199
D789,565 S * 6/2017 Lopez ..... D25/199
9,775,260 B1 * 9/2017 Warlick ..... H05K 7/14
D821,850 S * 7/2018 Tyrer ..... F16B 13/066 D8/354
2004/0007150 A1 1/2004 Gleave
2004/0035993 A1 2/2004 Curtin
2006/0059844 A1 3/2006 Ely
2007/0164182 A1 * 7/2007 MacKay ..... A63B 69/0048 248/300
2007/0272811 A1 11/2007 Baake
2008/0271407 A1 11/2008 Snider et al.
2012/0067667 A1 * 3/2012 Marcoux ..... A62B 35/0068 182/3
2012/0317892 A1 12/2012 Crookston
2013/0067848 A1 3/2013 Ferris
2014/0182218 A1 7/2014 O'Donnell
2015/0107184 A1 4/2015 Nichols, Jr.
2017/0138533 A1 * 5/2017 Maurice ..... F16B 13/0891
2017/0268243 A1 * 9/2017 Lopez ..... A62B 35/0068

FOREIGN PATENT DOCUMENTS

WO 2008/055063 A1 5/2008
WO 2010/000035 A1 1/2010

OTHER PUBLICATIONS

Dictionary.com, Definition of Trapezoid, Retrieved Jun. 24, 2018, http://www.dictionary.com/browse/trapezoid. (Year: 2018).*
Merriam-Webster, Definition of Trapezoid, Retrieved Jun. 24, 2018, https://www.merriam-webster.com/dictionary/trapezoid. (Year: 2018).*
European Patent Office, "Extended European Search Report from corresponding EP Regional application No. EP 17 16 1100.7", dated Jul. 5, 2017, 7 pp.

* cited by examiner

MONOLITHIC ROOF ANCHOR

BACKGROUND

Field

The disclosed concept relates generally to roof anchors, and in particular, to monolithic roof anchors.

Background Information

In fall protection systems, a worker typically wears a safety harness with an attached lifeline. The lifeline is then attached to an anchor, such as a roof anchor. Roof anchors are attached, either permanently or temporarily, to a roof and include an opening or ring that a lifeline can attach to.

It is critical that a roof anchor is able to endure the stress put on it when a worker starts to fall. Multi-piece roof anchors necessarily have joints between the pieces of the roof anchor. Whether the pieces of the roof anchor are welded together or attached together with fasteners, the joints can cause a weak point in the roof anchor and present a risk of the roof anchor failing due to the stress a lifeline places on it when a worker starts to fall.

In addition to failure at a joint, roof anchors are subjected to a torque force applied to the fasteners that attach the roof anchor to a roof. Depending on the construction of the roof anchor, the torque forces placed on the fasteners can be considerable and potentially cause the roof anchor to pull away from the roof it is installed on.

It is important that roof anchors are designed to reduce the potential of failure as much as is practically possible. It is also beneficial to control the cost of the materials and manufacturing of roof anchors while reducing the potential of failure. There is room for improvement in roof anchors.

SUMMARY

These needs and others are met by embodiments of the disclosed concept in which a roof anchor is formed from a monolithic piece including an anchor portion disposed substantially perpendicular with respect to a mounting portion. combination receptacle includes a socket configured to provide wired power and a wireless power transmitter configured to wirelessly transmit power.

In accordance with one aspect of the disclosed concept, a roof anchor comprises: a mounting portion including a plurality of holes formed therein; an anchor portion having an opening formed therein; and wherein the mounting portion and the anchor portion are planar members arranged substantially perpendicular with each other, wherein the anchor portion is disposed along one side of the mounting portion with a bend portion formed at an intersection of the mounting portion and the anchor portion; wherein the mounting portion and the anchor portion form a monolithic piece, and wherein the opening includes a lower edge and an upper edge, wherein the lower edge is closer to the mounting portion than the upper edge, and wherein a length of the lower edge is greater than a length of the upper edge.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
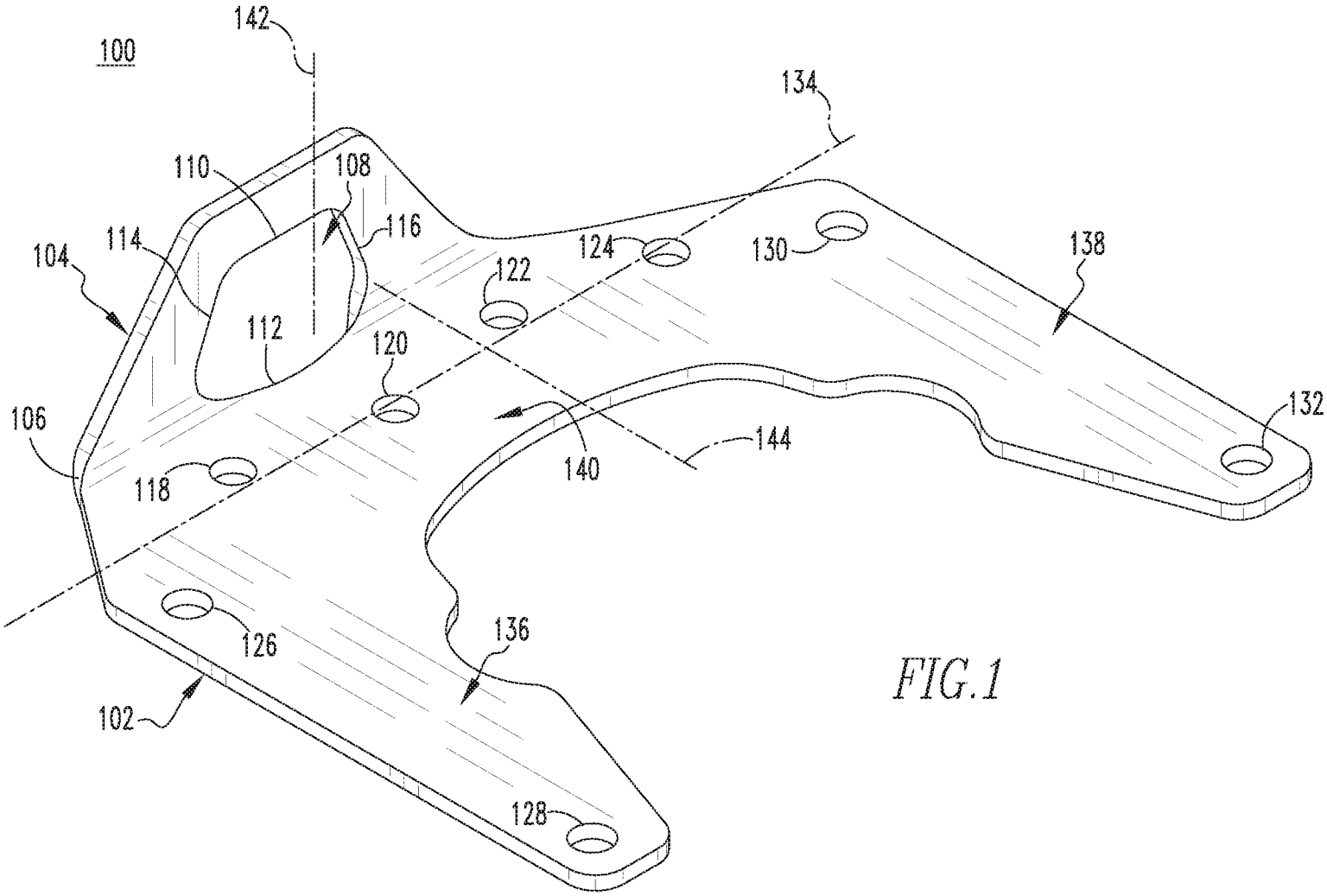
FIG. 1 is an isometric view of a roof anchor in accordance with an example embodiment of the disclosed concept.

Directional phrases used herein, such as, for example, left, right, front, back, top, bottom and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "monolithic piece" shall mean a part that is formed from a single piece of material, such as a single piece of metal. Two or more pieces of material joined together via, for example, welding or fastening, are not to be construed as a monolithic piece.

Figure 2:
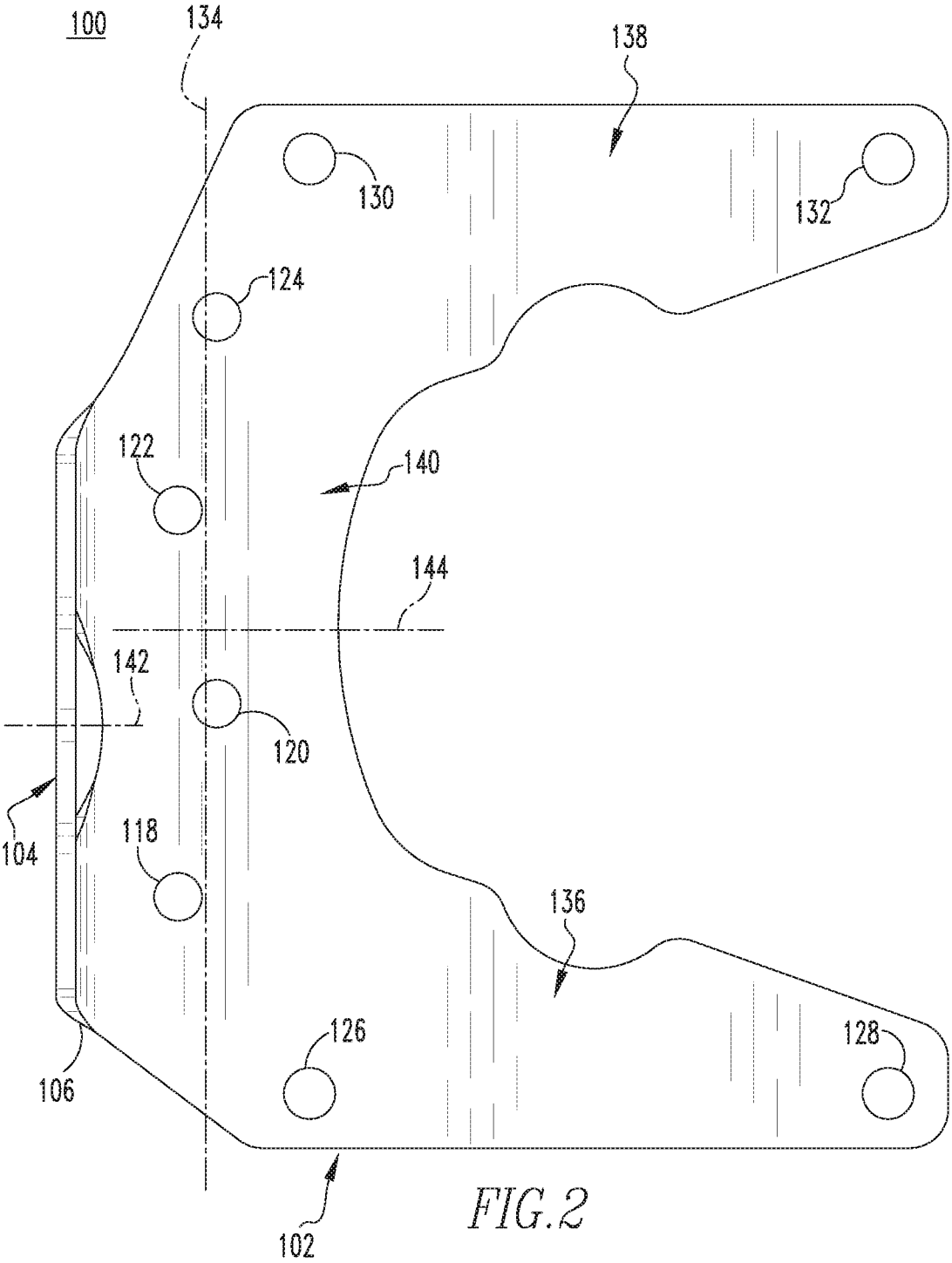
FIG. 2 is a top view of the roof anchor of FIG. 1.
Figure 3:
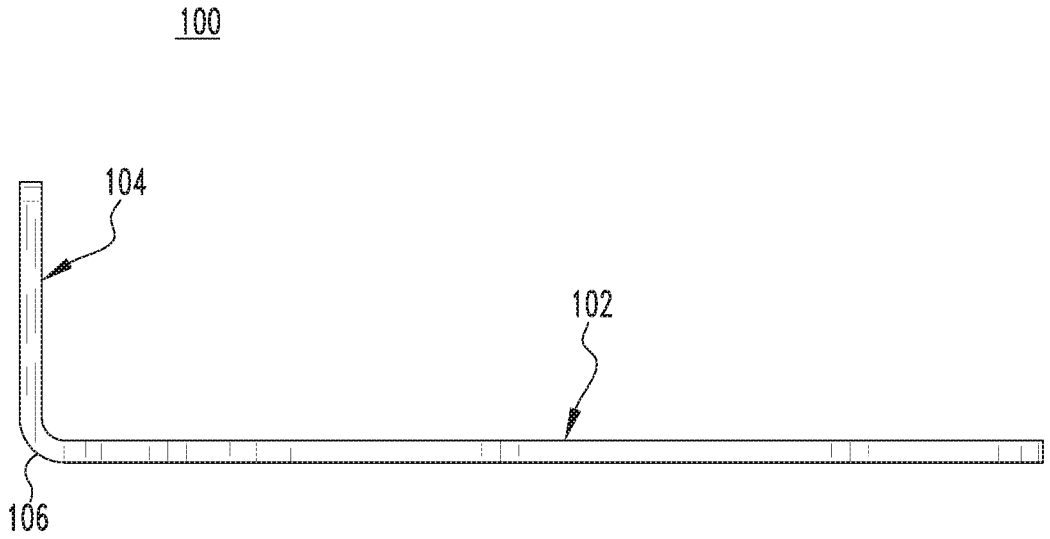
FIG. 3 is a side view of the roof anchor of FIG. 1.

An isometric view of a roof anchor 100 in accordance with an example embodiment of the disclosed concept is shown in FIG. 1. A top view of the roof anchor 100 of FIG. 1 is shown in FIG. 2 and a side view of the roof anchor of FIG. 1 is shown in FIG. 3. The roof anchor 100 includes a mounting portion 102 and an anchor portion 104. The mounting portion 102 and the anchor portion 104 are planar members that are disposed perpendicular with each other. The anchor portion 104 is disposed at the one of the edges of the mounting portion 102.

The roof anchor 100 is formed as a monolithic piece. That is, the mounting portion 102 and the anchor portion 104 are formed from a single piece of material. The intersection of the mounting portion 102 and the anchor portion 104 is a bend portion 106. At the bend portion 106, the roof anchor is bent so that the mounting portion 102 and the anchor portion 104 are disposed substantially perpendicular with respect to each other.

The roof anchor 100 may be formed from an initially flat monolithic piece that is then bent at bend portion 106 so that the mounting portion 102 and anchor portion 104 are disposed substantially perpendicular with respect to each other. By forming the roof anchor 100 as a monolithic piece, rather than by welding or otherwise attaching multiple pieces together, the structural strength of the roof anchor 100 is improved. Furthermore, by disposing the anchor portion 104 at one edge of the mounting portion 102, the roof anchor 100 may be initially formed as a flat piece and bent at bend portion 106, which can simplify and reduce production costs compared to other manufacturing techniques such as casting the roof anchor 100 in its final form. Initially forming the roof anchor 100 as a flat piece would be much more difficult and possibly not possible if the anchor portion 104 were not disposed along one of the edges of the mounting portion 102.

The anchor portion 104 has an opening 108 formed in it. The opening 108 has a trapezoidal shape. The trapezoidal shape of the opening 108 includes an upper edge 110 and a lower edge 112. The lower edge 112 is disposed closer to the mounting portion 102 than the upper edge 110. The lower edge 112 also has a greater length than the upper edge 110. The trapezoidal shape of the opening 108 also includes side edges 114 and 116 that connect the upper and lower edges 110 and 112. Due to the difference in lengths between the upper and lower edges 110 and 112, the distance between the side edges 114 and 116 is smaller where they meet the upper edge 110 and greater where they meet the lower edge 112.

The trapezoidal shape of the opening 108 that gets wider in the area nearer the mounting portion 102 will naturally cause a lifeline attachment to slide down to the lower portion of the opening 108 (i.e., the base of the trapezoidal shape) in the case of a fall. The structural strength of the roof anchor 100 is greater at the lower portion of the opening 108 compared to the upper portion of the opening 108. Additionally, less torque is applied to the mounting portion 102 when the tension of the lifeline is applied to the lower portion of the opening 108 since the distance between the lower portion of the opening 108 and the plane of the mounting portion 102 is very small.

Figure 7:
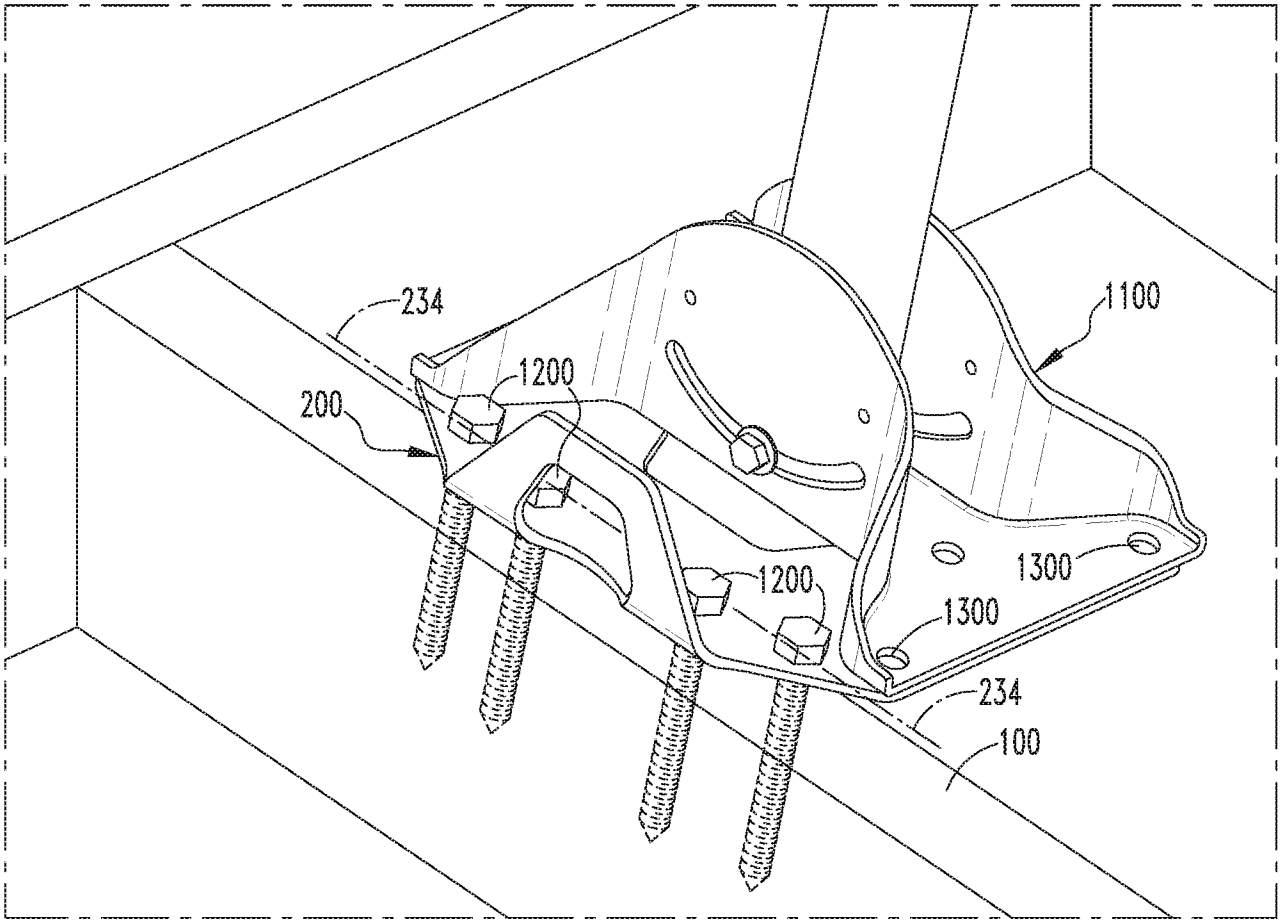
FIG. 7 is a view of the roof anchor of FIG. 4 employed in conjunction with a mounting bracket.

The mounting portion 102 has holes 118,120,122,124, 126,128,130,132 formed in it. The holes 118,120,122,124, 126,128,130,132 includes anchor holes 118,120,122,124 and mounting bracket holes 126,128,130,132. A primary purpose of the anchor holes 118,120,122,124 is to anchor the mounting portion 102 to a surface such as a roof and a primary purpose of the mounting bracket holes 126,128,130, 132 is to allow a mounting bracket, such as a satellite dish mounting bracket to be attached to the roof anchor 100 (FIG. 7 illustrates an example embodiment of the disclosed concept attached to a roof and a satellite dish mounting bracket). Although four anchor holes 118,120,122,124 and four mounting bracket holes 126,128,130,132 are shown in the roof anchor 100, it will be appreciated by those having ordinary skill in the art that the number of holes may be varied without departing from the scope of the disclosed concept. In some example embodiments of the disclosed concept, the holes 118,120,122,124,126,128,130,132 are sized to accept a suitable type of fastener such as, for example and without limitation, a mounting screw. It will also be appreciated by the those having ordinary skill in the art that the holes 118,120,122,124,126,128,130,132 may each have the same size or may have different sizes without departing from the scope of the disclosed concept.

The mounting bracket holes 126,128,130,132 are arranged in a substantially rectangular shape, which is common among many types of mounting brackets. In some example embodiments of the disclosed concept, the spacing of the individual mounting bracket holes 126,128,130,132 may be selected to correspond to the spacing commonly used in satellite dish mounting brackets, such as the satellite dish brackets disclosed in U.S. Pat. No. 7,057,575 or U.S. Patent Application Publication No. 2006/0016947, the disclosures of which are hereby incorporated by reference in their entireties. In some example embodiments of the disclosed concept, one side of the length of the rectangular shape of the mounting bracket holes 126,128,130,132 has a length of about 6 inches and another side of the rectangular shape has a length of about 3.75 inches. However, it will be appreciated by those having ordinary skill in the art, that any spacing between mounting bracket holes 126,128,130,132 may be selected without departing from the scope of the disclosed concept.

In some example embodiments of the disclosed concept, the anchor holes 118,120,122,124 are arranged in a staggered manner substantially about a common axis 134. In other words, the anchor holes 118,120,122,124 may not be perfectly aligned along the common axis, one having ordinary skill in the art will still recognize the common axis 134 along which the anchor holes 118,120,122,124 are disposed.

The mounting portion 102 of the roof anchor 100 includes a core portion 140 and leg portions 136,138 extending from the core portion 140. Together, the core portion 140 and the leg portions 136,138 substantially form a "C" shape. One side of the core portion 140 is disposed adjacent to the anchor portion 104 and the leg portions 136,138 extend from a side of the core portion 140 opposite of the anchor portion 104. In other words, the core portion 140 is disposed between the anchor portion 104 and the leg portions 136, 138.

The anchor holes 118,120,122,124 are disposed in the core portion 140. At least two of the mounting bracket holes 128,132 are disposed in the leg portions 136,138. However, it will be appreciated by those having ordinary skill in the art that, in some embodiments of the disclosed concept, all of the mounting bracket holes 128,132 may be disposed in the leg portions 136,138.

In the roof anchor 100, a centerline 144 of the core portion 140 is offset with respect to a centerline 142 of the anchor portion 104. In other words, the center of the anchor portion 104 is not aligned with the center of the core portion 140. However, it will be appreciated by those having ordinary skill in the art that in some embodiments of the disclosed concept, the centers of the anchor portion 104 and core portion 140 may be aligned with each other.

Figure 4:
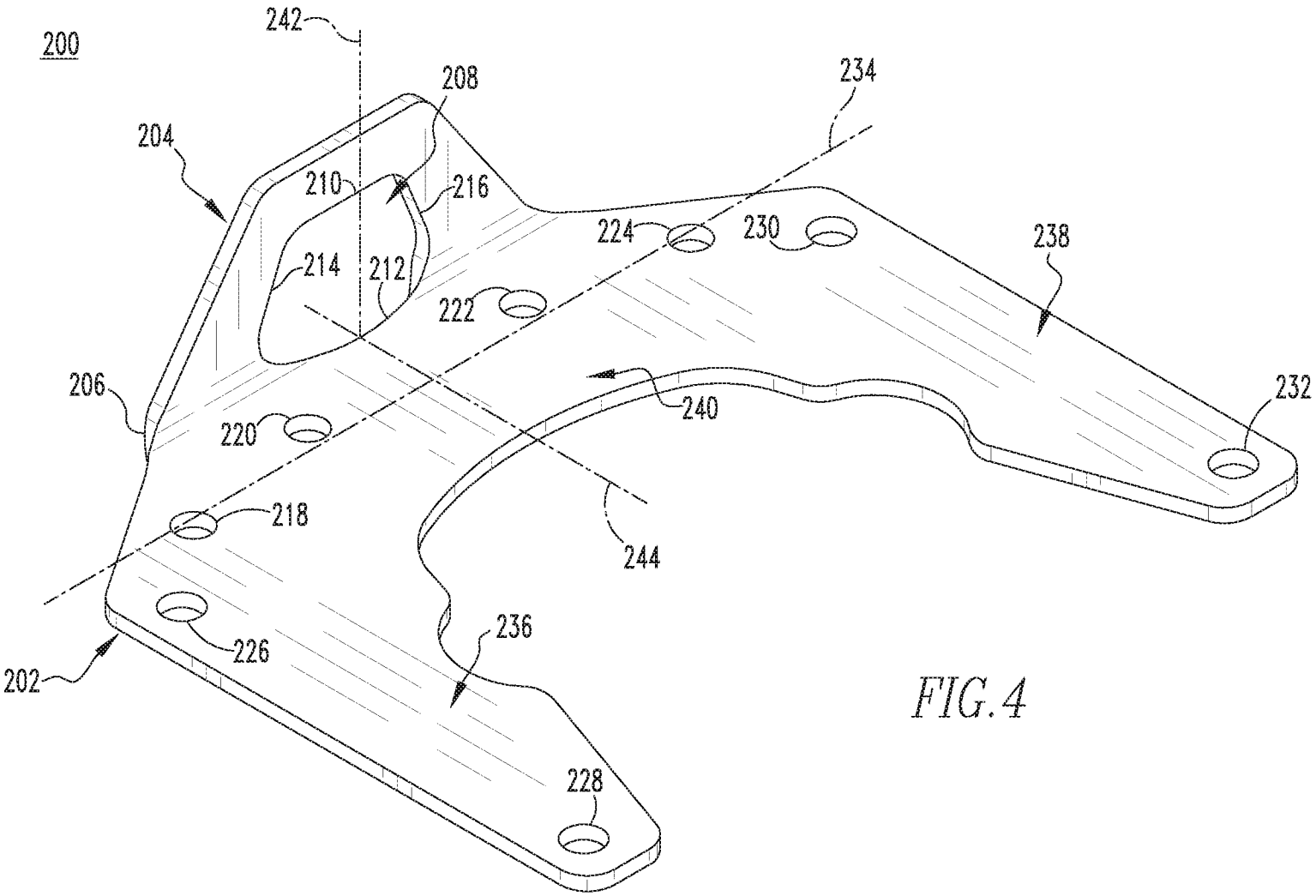
FIG. 4 is an isometric view of a roof anchor in accordance with another example embodiment of the disclosed concept.
Figure 5:
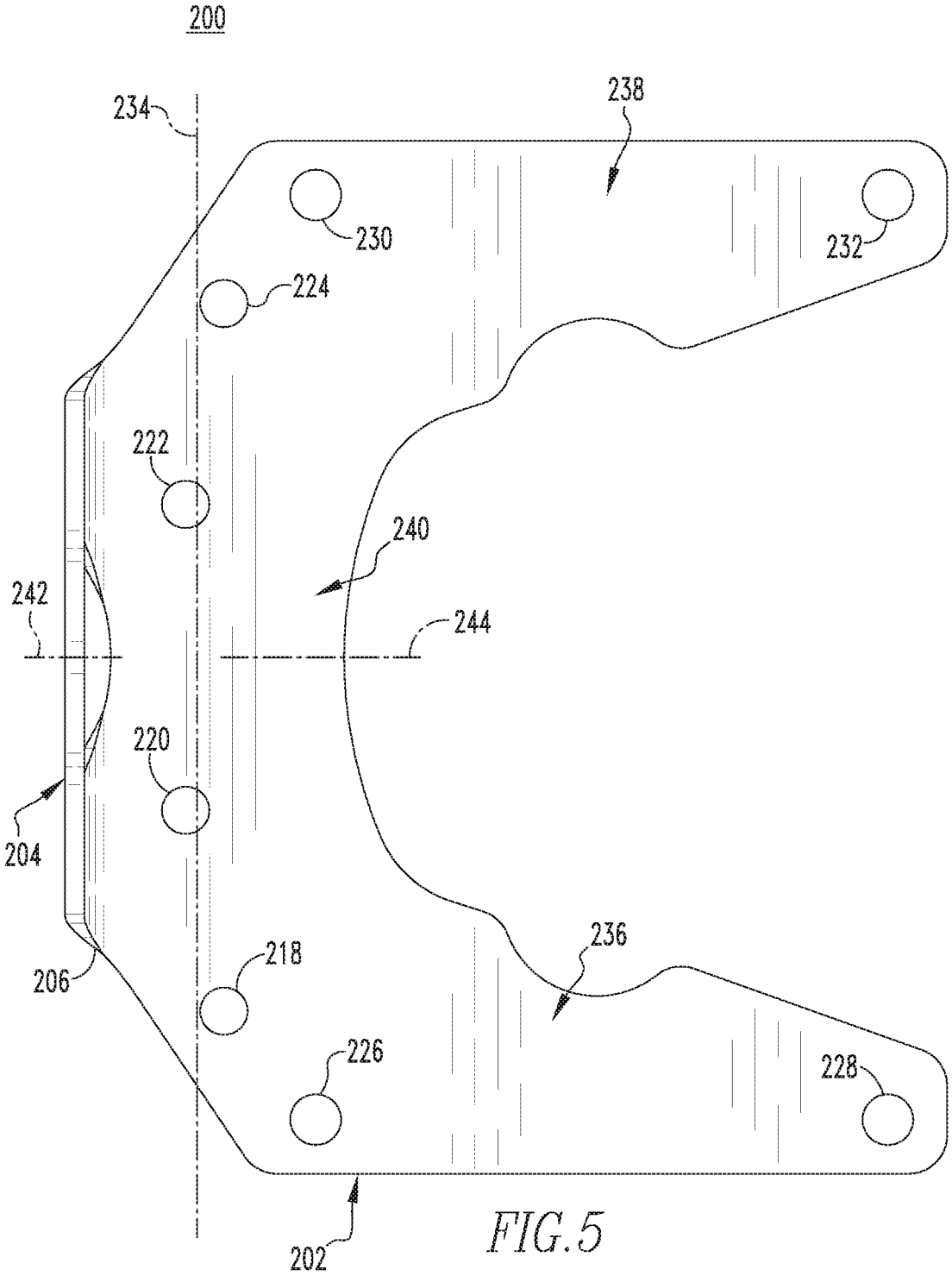
FIG. 5 is a top view of the roof anchor of FIG. 4.
Figure 6:
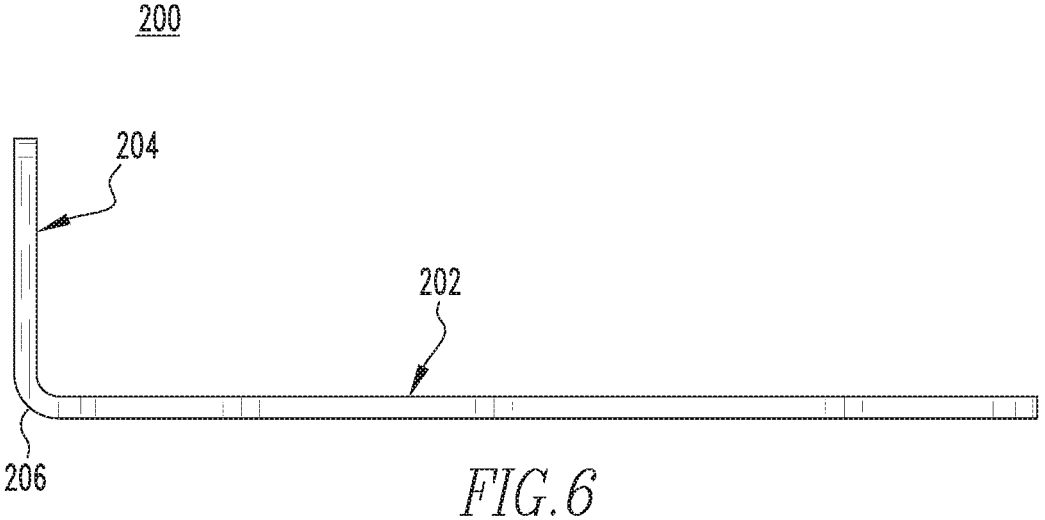
FIG. 6 is a side view of the roof anchor of FIG. 4.

FIG. 4 is an isometric view of a roof anchor 200 in accordance with another example embodiment of the disclosed concept. FIG. 5 is a top view of the roof anchor 200 of FIG. 4 and FIG. 6 is a side view of the roof anchor 200 of FIG. 4. The roof anchor 200 of FIGS. 4-6 is similar to the roof anchor 100 of FIGS. 1-3, except that the roof anchor 200 includes an anchor portion 204 whose centerline 242 is aligned with a centerline 244 of a core portion 240. Although the roof anchor 100 and 200 include many of the same or similar elements, the roof anchor 200 is described fully herein to ensure completeness and clarity of disclosure.

The roof anchor 200 includes a mounting portion 202 and an anchor portion 204. The mounting portion 202 and the anchor portion 204 are planar members that are disposed perpendicular with each other. The anchor portion 204 is disposed at the one of the edges of the mounting portion 202.

The roof anchor 200 is formed as a monolithic piece. That is, the mounting portion 202 and the anchor portion 204 are formed from a single piece of material. The intersection of the mounting portion 202 and the anchor portion 204 is a bend portion 206. At the bend portion 206, the roof anchor is bent so that the mounting portion 202 and the anchor portion 204 are disposed substantially perpendicular with respect to each other.

The roof anchor 200 may be formed from an initially flat monolithic piece that is then bent at bend portion 206 so that the mounting portion 202 and anchor portion 204 are disposed substantially perpendicular with respect to each other. By forming the roof anchor 200 as a monolithic piece, rather than by welding or otherwise attaching multiple pieces together, the structural strength of the roof anchor 200 is improved. Furthermore, by disposing the anchor portion 204 at one edge of the mounting portion 202, the roof anchor 200 may be initially formed as a flat piece and bent at bend portion 206, which can simplify and reduce production costs compared to other manufacturing techniques such as casting the roof anchor 200 in its final form. Initially forming the roof anchor 200 as a flat piece would be much more difficult and possibly not possible if the anchor portion 204 were not disposed along one of the edges of the mounting portion 202.

The anchor portion 204 has an opening 208 formed in it. The opening 208 has a trapezoidal shape. The trapezoidal shape of the opening 208 includes an upper edge 210 and a lower edge 212. The lower edge 212 is disposed closer to the mounting portion 202 than the upper edge 210. The lower edge 212 also has a greater length than the upper edge 210. The trapezoidal shape of the opening 208 also includes side edges 214 and 216 that connect the upper and lower edges 210 and 212. Due to the difference in lengths between the upper and lower edges 210 and 212, the distance between the side edges 214 and 216 is smaller where they meet the upper edge 210 and greater where they meet the lower edge 212.

The trapezoidal shape of the opening 208 that gets wider in the area nearer the mounting portion 202 will naturally cause a lifeline attachment to slide down to the lower portion of the opening 208 (i.e., the base of the trapezoidal shape) in the case of a fall. The structural strength of the roof anchor 200 is greater at the lower portion of the opening 208 compared to the upper portion of the opening 208. Additionally, less torque is applied to the mounting portion 202 when the tension of the lifeline is applied to the lower portion of the opening 208 since the distance between the lower portion of the opening 208 and the plane of the mounting portion 202 is very small.

The mounting portion 202 has holes 218,220,222,224, 226,228,230,232 formed in it. The holes 218,220,222,224, 226,228,230,232 includes anchor holes 218,220,222,224 and mounting bracket holes 226,228,230,232. A primary purpose of the anchor holes 218,220,222,224 is to anchor the mounting portion 202 to a surface such as a roof and a primary purpose of the mounting bracket holes 226,228,230, 232 is to allow a mounting bracket, such as a satellite dish mounting bracket to be attached to the roof anchor 200.

Referring to FIG. 7, an example of the roof anchor 200 attached to a roof and a satellite dish mounting bracket 1000 is shown. It will be appreciated by those having ordinary skill in the art that the roof anchor 100 of FIGS. 1-3 may be similar attached to the satellite dish mounting bracket 1000. As shown in FIG. 7, the satellite dish mounting bracket 1100 includes holes 1300. The holes 1300 of the satellite dish mounting bracket 1100 are aligned with the mounting bracket holes 226,228,230,232, although the mounting bracket holes 226,228,230,232 are hidden in FIG. 7. FIG. 7 also illustrates that fasteners such as, for example and without limitation, mounting screws 1200, may be used in conjunction with anchor holes 218,220,222,224 (hidden from view by the mounting screws 1200) to attach the roof anchor 200 to the roof by, for example, screwing the mounting screws 1200 into a rafter 1000 or other member of the roof. Also, as shown in FIG. 7, the staggering the anchor holes 218,220,222,224 about the common axis 234 allows the anchor holes 218,220,222,224 to all fall along one rafter 1000 when the roof anchor 200 is installed on the roof.

Referring back to FIGS. 3-6, the roof anchor 200 includes four anchor holes 218,220,222,224 and four mounting bracket holes 226,228,230,232. However, it will be appreciated by those having ordinary skill in the art that the number of holes may be varied without departing from the scope of the disclosed concept. In some example embodiments of the disclosed concept, the holes 218,220,222,224, 226,228,230,232 are sized to accept a suitable type of fastener such as, for example and without limitation, a mounting screw. It will also be appreciated by the those having ordinary skill in the art that the holes 218,220,222, 224,226,228,230,232 may each have the same size or may have different sizes without departing from the scope of the disclosed concept.

The mounting bracket holes 226,228,230,232 are arranged in a substantially rectangular shape, which is common among many types of mounting brackets, such as the satellite dish mounting bracket 1100 shown in FIG. 7. In some example embodiments of the disclosed concept, the spacing of the individual mounting bracket holes 226,228, 230,232 may be selected to correspond to the spacing commonly used in satellite dish mounting brackets, such as the satellite dish brackets disclosed in U.S. Pat. No. 7,057, 575 or U.S. Patent Application Publication No. 2006/ 0016947. In some example embodiments of the disclosed concept, one side of the length of the rectangular shape of the mounting bracket holes 226,228,230,232 has a length of about 6 inches and another side of the rectangular shape has a length of about 3.75 inches. However, it will be appreciated by those having ordinary skill in the art, that any spacing between mounting bracket holes 226,228,230,232 may be selected without departing from the scope of the disclosed concept.

In some example embodiments of the disclosed concept, the anchor holes 218,220,222,224 are arranged in a staggered manner substantially about a common axis 234. In other words, the anchor holes 218,220,222,224 may not be perfectly aligned along the common axis, one having ordinary skill in the art will still recognize the common axis 234 along which the anchor holes 218,220,222,224 are disposed.

The mounting portion 202 of the roof anchor 200 includes a core portion 240 and leg portions 236,238 extending from the core portion 240. Together, the core portion 240 and the leg portions 236,238 substantially form a "C" shape. One side of the core portion 240 is disposed adjacent to the anchor portion 204 and the leg portions 236,238 extend from a side of the core portion 240 opposite of the anchor portion 204. In other words, the core portion 240 is disposed between the anchor portion 204 and the leg portions 236, 238.

The anchor holes 218,220,222,224 are disposed in the core portion 240. At least two of the mounting bracket holes 228,232 are disposed in the leg portions 236,238. However, it will be appreciated by those having ordinary skill in the art that, in some embodiments of the disclosed concept, all of the mounting bracket holes 228,232 may be disposed in the leg portions 236,238.

In the roof anchor 200, the centerline 244 of the core portion 240 is aligned with respect to the centerline 242 of the anchor portion 204. In other words, the center of the anchor portion 204 aligned with the center of the core portion 240, as shown in FIGS. 4 and 5. However, it will be appreciated by those having ordinary skill in the art that in some embodiments of the disclosed concept, such as in the roof anchor 100 of FIGS. 1-3, the centers of the anchor portion 204 and core portion 240 may be offset with respect to each other.

Figure 8:
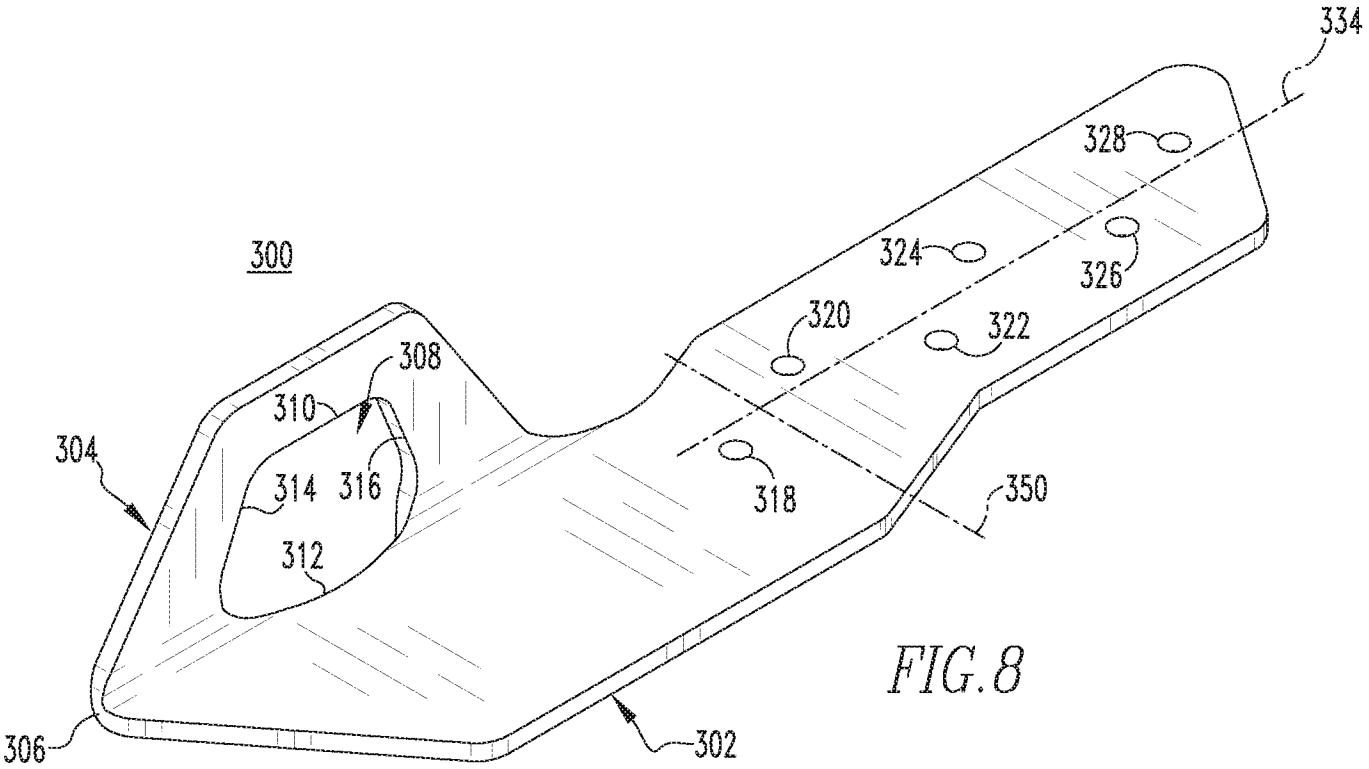
FIG. 8 is an isometric view of a roof anchor in accordance with another example embodiment of the disclosed concept.
Figure 9:
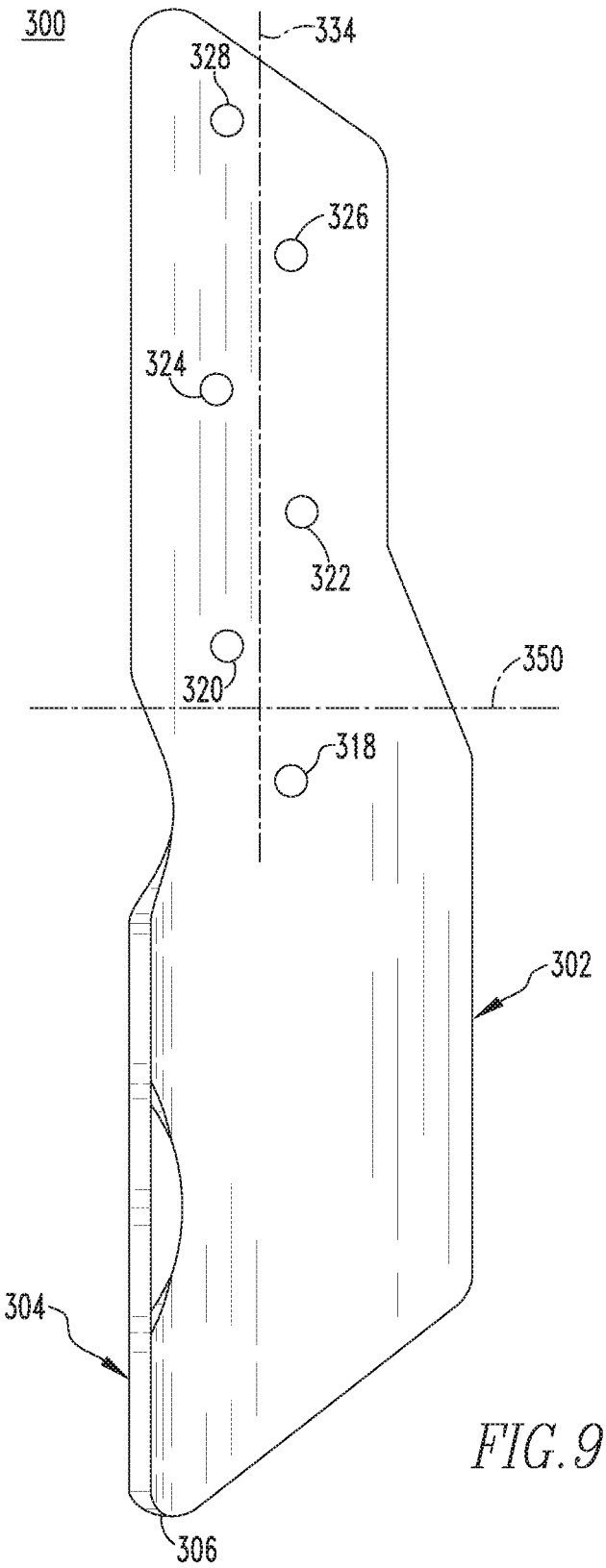
FIG. 9 is a top view of the roof anchor of FIG. 8.
Figure 10:
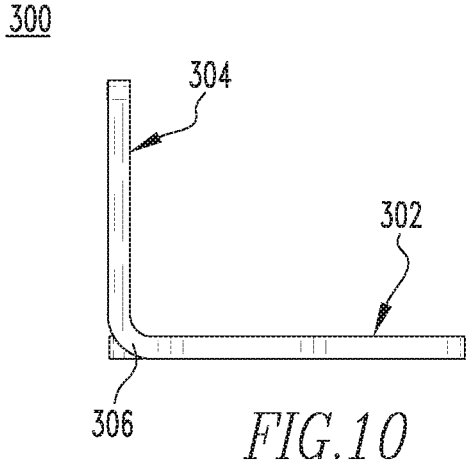
FIG. 10 is a side view of the roof anchor of FIG. 8.

FIG. 8 is an isometric view of a roof anchor 300 in accordance with another example embodiment of the disclosed concept. FIG. 9 is a top view of the roof anchor 300 of FIG. 8 and FIG. 10 is a side view of the roof anchor 300 of FIG. 8. Although the roof anchor 300 of FIGS. 8-10 includes some of the same or similar elements as the roof anchor 100 of FIGS. 1-3, the roof anchor 300 is described fully herein to ensure completeness and clarity of disclosure.

The roof anchor 300 includes a mounting portion 302 and an anchor portion 304. The mounting portion 302 and the anchor portion 304 are planar members that are disposed perpendicular with each other. The anchor portion 304 is disposed at the one of the edges of the mounting portion 302.

The mounting portion 302 is also an elongated member whose length is substantially greater than its width. In some exemplary embodiments of the disclosed concept, the anchor portion 304 is substantially disposed adjacent to one end of the length of the mounting portion 302, as is shown in FIG. 8. Furthermore, in some exemplary embodiments of the disclosed concept, the anchor portion 304 does not cross a midpoint of the length of the mounting portion 302. In other words, the midpoint of the length of the mounting portion 302 is located along an axis 350 that divides the mounting portion 302 in half along its length and the anchor portion 304 does not cross the axis 350.

The roof anchor 300 is formed as a monolithic piece. That is, the mounting portion 302 and the anchor portion 304 are formed from a single piece of material. The intersection of the mounting portion 302 and the anchor portion 304 is a bend portion 306. At the bend portion 306, the roof anchor is bent so that the mounting portion 302 and the anchor portion 304 are disposed substantially perpendicular with respect to each other.

The roof anchor 300 may be formed from an initially flat monolithic piece that is then bent at bend portion 306 so that the mounting portion 302 and anchor portion 304 are disposed substantially perpendicular with respect to each other. By forming the roof anchor 300 as a monolithic piece, rather than by welding or otherwise attaching multiple pieces together, the structural strength of the roof anchor 300 is improved. Furthermore, by disposing the anchor portion 304 at one edge of the mounting portion 302, the roof anchor 300 may be initially formed as a flat piece and bent at bend portion 306, which can simplify and reduce production costs compared to other manufacturing techniques such as casting the roof anchor 300 in its final form. Initially forming the roof anchor 300 as a flat piece would be much more difficult and possibly not possible if the anchor portion 304 were not disposed along one of the edges of the mounting portion 302.

The anchor portion 304 has an opening 308 formed in it. The opening 308 has a trapezoidal shape. The trapezoidal shape of the opening 308 includes an upper edge 310 and a lower edge 312. The lower edge 312 is disposed closer to the mounting portion 302 than the upper edge 310. The lower edge 312 also has a greater length than the upper edge 310. The trapezoidal shape of the opening 308 also includes side edges 314 and 316 that connect the upper and lower edges 310 and 312. Due to the difference in lengths between the upper and lower edges 310 and 312, the distance between the side edges 314 and 316 is smaller where they meet the upper edge 310 and greater where they meet the lower edge 312.

The trapezoidal shape of the opening 308 that gets wider in the area nearer the mounting portion 302 will naturally cause a lifeline attachment to slide down to the lower portion of the opening 308 (i.e., the base of the trapezoidal shape) in the case of a fall. The structural strength of the roof anchor 300 is greater at the lower portion of the opening 308 compared to the upper portion of the opening 308. Additionally, less torque is applied to the mounting portion 302 when the tension of the lifeline is applied to the lower portion of the opening 308 since the distance between the lower portion of the opening 308 and the plane of the mounting portion 302 is very small.

The mounting portion 302 has holes 318,320,322,324,326,328 formed in it. Unlike the previously described roof anchors 100 and 200, all of the holes 318,320,322,324,326,328 of the roof anchor 300 are anchor holes. A primary purpose of the anchor holes 318,320,322,324,326,328 is to anchor the mounting portion 302 to a surface such as a roof.

The roof anchor 300 includes six anchor holes 318,320,322,324,326,328. However, it will be appreciated by those having ordinary skill in the art that the number of holes may be varied without departing from the scope of the disclosed concept. In some example embodiments of the disclosed concept, the holes 318,320,322,324,326,328 are sized to accept a suitable type of fastener such as, for example and without limitation, a mounting screw. It will also be appreciated by the those having ordinary skill in the art that the holes 318,320,322,324,326,328 may each have the same size or may have different sizes without departing from the scope of the disclosed concept.

In some example embodiments of the disclosed concept, the anchor holes 318,320,322,324,326,328 are arranged in a staggered manner substantially about a common axis 334. In other words, the anchor holes 318,320,322,324,326,328 may not be perfectly aligned along the common axis, one having ordinary skill in the art will still recognize the common axis 334 along which the anchor holes 318,320,322,324,326,328 are disposed. Furthermore, in some exemplary embodiments of the disclosed concept, the anchor holes 318,320,322,324,326,328 are staggered about the common axis 334 beginning proximate to one end of the mounting portion 302 and the anchor portion 304 is disposed proximate an opposite end of the mounting portion 302. Additionally, in some exemplary embodiments of the disclosed concept, the anchor portion 304 is disposed along a first portion of the length of the mounting portion 302 and the holes 318,320,322,324,326,328 are disposed along a second portion of the length of the mounting portion 302 that does not overlap with the first portion, as is shown in FIG. 8. By arranging the anchor portion 304 and the holes 318,320,322,324,326,328 in this manner, the portion of the mounting portion 302 including the holes 318,320,322,324,326,328 can be placed under a shingle or other member so as to be hidden from sight while the anchor portion 304 may remain exposed so as to facilitate connection of a lifeline to the anchor portion 304.

Figure 11:
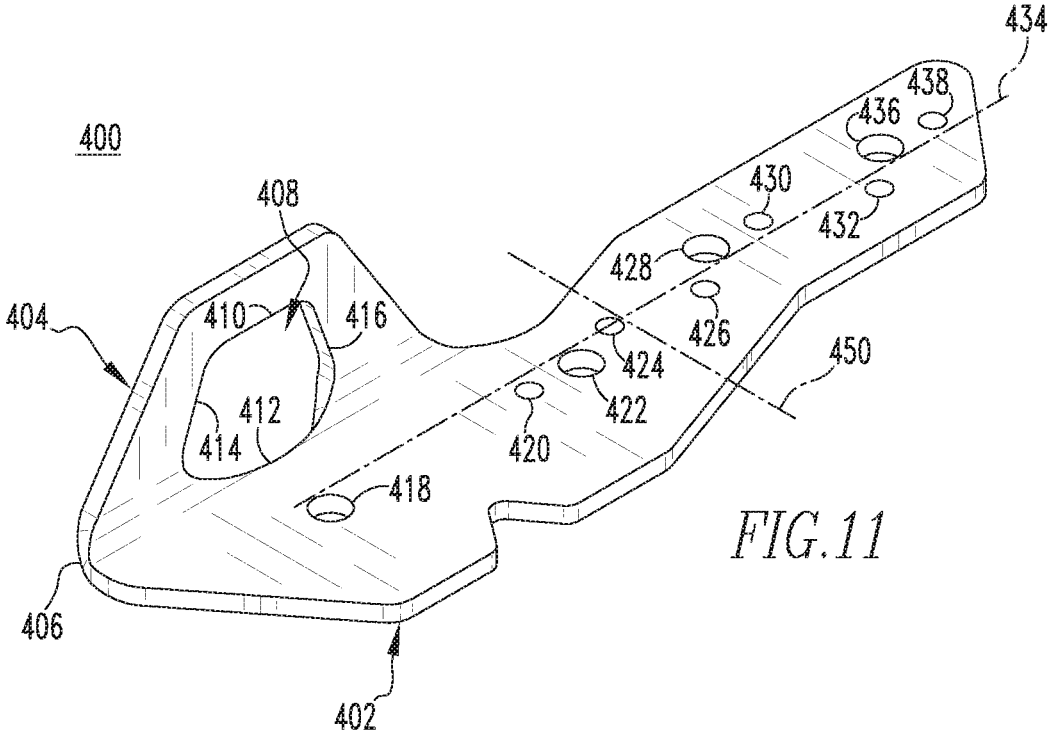
FIG. 11 is an isometric view of a roof anchor in accordance with another example embodiment of the disclosed concept.
Figure 12:
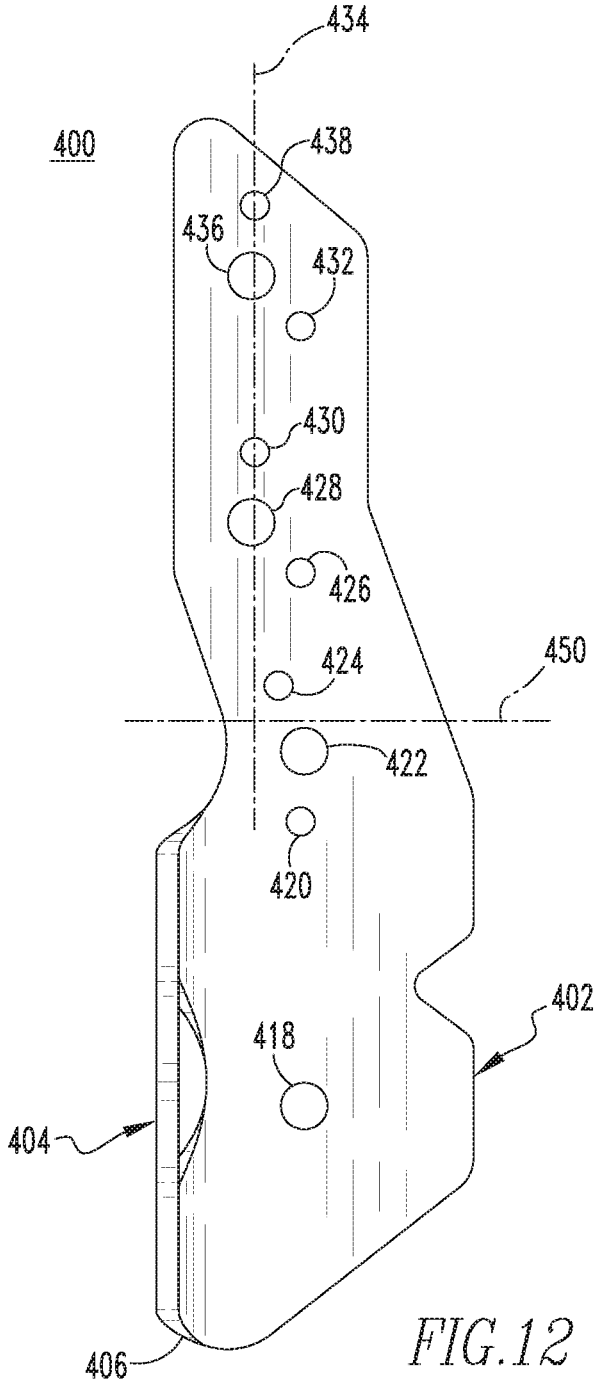
FIG. 12 is a top view of the roof anchor of FIG. 11.
Figure 13:
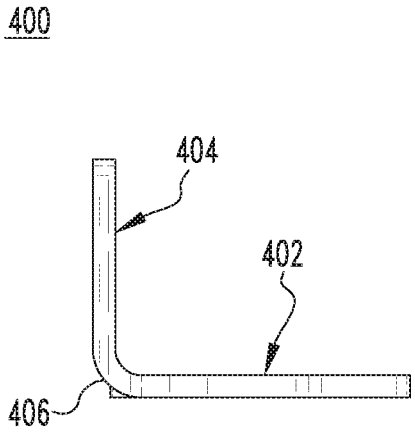
FIG. 13 is a side view of the roof anchor of FIG. 11.

FIG. 11 is an isometric view of a roof anchor 400 in accordance with another example embodiment of the disclosed concept. FIG. 12 is a top view of the roof anchor 400 of FIG. 11 and FIG. 13 is a side view of the roof anchor 400 of FIG. 11. Although the roof anchor 400 of FIGS. 11-13 includes some of the same or similar elements as the roof anchor 300 of FIGS. 8-10, the roof anchor 400 is described fully herein to ensure completeness and clarity of disclosure.

The roof anchor 400 includes a mounting portion 402 and an anchor portion 404. The mounting portion 402 and the anchor portion 404 are planar members that are disposed perpendicular with each other. The anchor portion 404 is disposed at the one of the edges of the mounting portion 402.

The mounting portion 402 is also an elongated member whose length is substantially greater than its width. In some exemplary embodiments of the disclosed concept, the anchor portion 404 is substantially disposed adjacent to one end of the length of the mounting portion 402, as is shown in FIG. 11. Furthermore, in some exemplary embodiments of the disclosed concept, the anchor portion 404 does not cross a midpoint of the length of the mounting portion 402. In other words, the midpoint of the length of the mounting portion 402 is located along an axis 450 that divides the mounting portion 302 in half along its length and the anchor portion 404 does not cross the axis 450.

The roof anchor 400 is formed as a monolithic piece. That is, the mounting portion 402 and the anchor portion 404 are formed from a single piece of material. The intersection of the mounting portion 402 and the anchor portion 404 is a bend portion 406. At the bend portion 406, the roof anchor is bent so that the mounting portion 402 and the anchor portion 404 are disposed substantially perpendicular with respect to each other.

The roof anchor 400 may be formed from an initially flat monolithic piece that is then bent at bend portion 406 so that the mounting portion 402 and anchor portion 404 are disposed substantially perpendicular with respect to each other. By forming the roof anchor 400 as a monolithic piece, rather than by welding or otherwise attaching multiple pieces together, the structural strength of the roof anchor 400 is improved. Furthermore, by disposing the anchor portion 404 at one edge of the mounting portion 402, the roof anchor 400 may be initially formed as a flat piece and bent at bend portion 406, which can simplify and reduce production costs compared to other manufacturing techniques such as casting the roof anchor 400 in its final form. Initially forming the roof anchor 400 as a flat piece would be much more difficult and possibly not possible if the anchor portion 404 were not disposed along one of the edges of the mounting portion 402.

The anchor portion 404 has an opening 408 formed in it. The opening 408 has a trapezoidal shape. The trapezoidal shape of the opening 408 includes an upper edge 410 and a lower edge 412. The lower edge 412 is disposed closer to the mounting portion 402 than the upper edge 410. The lower edge 412 also has a greater length than the upper edge 410. The trapezoidal shape of the opening 408 also includes side edges 414 and 416 that connect the upper and lower edges 410 and 412. Due to the difference in lengths between the upper and lower edges 410 and 412, the distance between the side edges 414 and 416 is smaller where they meet the upper edge 410 and greater where they meet the lower edge 412.

The trapezoidal shape of the opening 408 that gets wider in the area nearer the mounting portion 402 will naturally cause a lifeline attachment to slide down to the lower portion of the opening 408 (i.e., the base of the trapezoidal shape) in the case of a fall. The structural strength of the roof anchor 400 is greater at the lower portion of the opening 408 compared to the upper portion of the opening 408. Additionally, less torque is applied to the mounting portion 402 when the tension of the lifeline is applied to the lower portion of the opening 408 since the distance between the lower portion of the opening 408 and the plane of the mounting portion 402 is very small.

The mounting portion 402 has holes 418,420,422,424,426,428,430,432,436,438 formed in it. Unlike the previously described roof anchors 100 and 200, all of the holes 418,420,422,424,426,428,430,432,436,438 of the roof anchor 400 are anchor holes. A primary purpose of the anchor holes 418,420,422,424,426,428,430,432,436,438 is to anchor the mounting portion 402 to a surface such as a roof.

The roof anchor 400 includes ten anchor holes 418,420,422,424,426,428,430,432,436,438. However, it will be appreciated by those having ordinary skill in the art that the number of holes may be varied without departing from the scope of the disclosed concept. The holes 418,420,422,424,426,428,430,432,436,438 includes a first hole 418, a second set of holes 420,424,426,430,432,438 and a third set of holes 422,428,436. In some exemplary embodiments of the disclosed concept, the second set of holes 420,424,426,430,432,438 have a different size that the third set of holes 422,428,436. For example, the second set of holes 420,424,426,430,432,438 may be sized to accept one type of fastener such as, for example and without limitation, a nail, and the third set of holes may be sized to accept a different type of fastener such as, for example and without limitation, a mounting screw. By including both the second set of holes 420,424,426,430,432,438 and the third set of holes 422,428,436, an installer is able to choose which type of fastener (e.g., a nail or a mounting screw) to use when installing the roof anchor 400. The first hole 418 may be sized to accept any suitable type of fastener such as, for example and without limitation, a mounting screw.

In some example embodiments of the disclosed concept, the holes 418,420,422,424,426,428,430,432,436,438 are arranged in a staggered manner substantially about a common axis 434. In other words, the holes 418,420,422,424,426,428,430,432,436,438 may not be perfectly aligned along the common axis, one having ordinary skill in the art will still recognize the common axis 434 along which the holes 418,420,422,424,426,428,430,432,436,438 are disposed. Furthermore, in some exemplary embodiments of the disclosed concept, the first and second sets of holes 420,422,424,426,428,430,432,436,438 are staggered about the common axis 434 beginning proximate to one end of the mounting portion 402 and the anchor portion 404 and the first hole 418 are disposed proximate an opposite end of the mounting portion 402.

In accordance with example embodiments of the disclosed concept, roof anchors described herein are rated for single-person fall arrest. The roof anchors described herein may be constructed of any suitable material such as, for example and without limitation, a metallic material such as steel, stainless steel, or type of high strength steel.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A roof anchor for a fall protection system, the roof anchor comprising:

a mounting portion including a plurality of holes formed therein;

an anchor portion having an opening formed therein; and wherein the mounting portion and the anchor portion are planar members arranged substantially perpendicular with each other, wherein the anchor portion is disposed along one side of the mounting portion with a bend portion formed at an intersection of the mounting portion and the anchor portion, wherein the mounting portion and the anchor portion form a monolithic piece, wherein the opening includes a lower edge and an upper edge, wherein the lower edge is closer to the mounting portion than the upper edge, and wherein a length of the lower edge is greater than a length of the upper edge, wherein the opening has a substantially trapezoidal shape, wherein the opening includes a first edge and a second edge, wherein the first and second edges of the opening extend between the upper edge and the lower edge of the opening, wherein the anchor portion includes a top edge, a first side edge extending substantially in parallel with the first edge of the opening from the top edge of the anchor portion to the mounting portion, and a second side edge extending substantially in parallel with the second edge of the opening from the top edge of the anchor portion to the mounting portion, wherein the top edge of the anchor portion is a free edge, wherein the mounting portion includes a core portion having a first side disposed adjacent to the anchor portion and a pair of leg portions extending away from a second side of the core portion opposite the first side, and wherein the core portion and the pair of leg portions substantially form a "C" shape.

2. The roof anchor of claim 1, wherein centerlines of the core portion and the anchor portion are aligned with respect to each other.

3. The roof anchor of claim 1, wherein centerlines of the core portion and the anchor portion are offset with respect to each other.

4. The roof anchor of claim 1, wherein the mounting portion and the anchor portion are composed of a metallic material.

5. The roof anchor of claim 1, wherein the upper edge of the opening extends substantially in parallel with the top edge of the anchor portion.

6. The roof anchor of claim 1, wherein a substantial portion of the opening is formed in the anchor portion and a bottom portion of the opening is formed in the bend portion.

7. The roof anchor of claim 1, wherein the pair of leg portions each have a notch formed therein facing a centerline of the mounting portion.

8. A roof anchor for a fall protection system, the roof anchor comprising:

a mounting portion including a plurality of holes formed therein;

an anchor portion having an opening formed therein; and wherein the mounting portion and the anchor portion are planar members arranged substantially perpendicular with each other, wherein the anchor portion is disposed along one side of the mounting portion with a bend portion formed at an intersection of the mounting portion and the anchor portion, wherein the mounting portion and the anchor portion form a monolithic piece, wherein the opening includes a lower edge and an upper edge, wherein the lower edge is closer to the mounting portion than the upper edge, and wherein a length of the lower edge is greater than a length of the upper edge, wherein the opening has a substantially trapezoidal shape, wherein the opening includes a first edge and a second edge, wherein the first and second edges of the opening extend between the upper edge and the lower edge of the opening, wherein the anchor portion includes a top edge, a first side edge extending substantially in parallel with the first edge of the opening from the top edge of the anchor portion to the mounting portion, and a second side edge extending substantially in parallel with the second edge of the opening from the top edge of the anchor portion to the mounting portion, wherein the top edge of the anchor portion is a free edge, wherein the mounting portion includes a core portion having a first side disposed adjacent to the anchor portion and a pair of leg portions extending away from a second side of the core portion opposite the first side, and wherein the plurality of holes include a plurality of anchor holes and a plurality of mounting bracket holes, wherein the plurality of anchor holes are staggered about a common axis and the plurality of mounting bracket holes are arranged in a substantially rectangular shape.

9. The roof anchor of claim 8, wherein the plurality of anchor holes are disposed in the core portion and at least one of the plurality of mounting bracket holes is disposed in one of the pair of leg portions.

10. The roof anchor of claim 8, wherein the plurality of anchor holes are four anchor holes and the plurality of mounting bracket holes are four mounting bracket holes.

* * * * *